US011129480B2

(12) United States Patent
López Gil

(10) Patent No.: US 11,129,480 B2
(45) Date of Patent: Sep. 28, 2021

(54) FOOTREST FOR CHAIR AND ARMCHAIR

(71) Applicant: Fama Sofas, S.L.U., Yecla (ES)

(72) Inventor: Félix López Gil, Yecla (ES)

(73) Assignee: FAMA SOFAS, S.L.U., Murcia (ES)

( * ) Notice: Subject to any disclaimer, the term of this patent is extended or adjusted under 35 U.S.C. 154(b) by 131 days.

(21) Appl. No.: 16/553,712

(22) Filed: Aug. 28, 2019

(65) Prior Publication Data

US 2020/0069065 A1 Mar. 5, 2020

(30) Foreign Application Priority Data

Aug. 31, 2018 (ES) ..... ES201831325U

(51) Int. Cl.
*A47C 7/50* (2006.01)
*A47C 7/52* (2006.01)

(52) U.S. Cl.
CPC ..... *A47C 7/5066* (2018.08)

(58) Field of Classification Search
CPC ..... A47C 7/5066
USPC ..... 297/423.19, 423.21, 423.37, 423.4
See application file for complete search history.

(56) References Cited

U.S. PATENT DOCUMENTS 155,016 A * 9/1874 Eberhard ..... A47C 7/506 297/423.21
280,160 A * 6/1883 Emerson et al. ..... A47C 3/029 297/271.2
503,246 A * 8/1893 McQuillen ..... A47C 7/506 297/423.4 X
694,538 A * 3/1902 Eddy ..... A47C 7/506 297/423.21 X
2,591,911 A 4/1952 Block
2,620,863 A * 12/1952 Cooper ..... A61B 90/60 297/188.2
3,227,491 A * 1/1966 Conrad ..... A47C 7/52 297/423.4
3,820,844 A * 6/1974 Fortnam ..... A61B 90/60 297/423.37
4,046,419 A * 9/1977 Schmitt ..... A47C 1/024 297/423.21 X
4,767,160 A * 8/1988 Mengshoel ..... A47C 7/52 297/423.12
5,098,160 A * 3/1992 Moore ..... A47C 16/025 297/423.21 X (Continued)

FOREIGN PATENT DOCUMENTS

ES 277001 U 7/1984
JP 2003116928 A 4/2003

(Continued)

*Primary Examiner* — Rodney B White
(74) *Attorney, Agent, or Firm* — Steven M. Greenberg, Esq.; Shutts & Bowen LLP

(57) ABSTRACT

A footrest for a chair or an armchair, includes a support platform for the feet of a user of said chair. Said platform is configured to be rotatably fastened to a leg of the chair or armchair, enabling the rotational movement of said platform in a horizontal plane. The platform includes at least one wheel which serves as a support on the ground, preventing the feet from being loaded on the cantilevered platform. In this manner, the footrest moves with the chair, always being available for the user, regardless of whether the chair moves, being able to be retracted underneath the legs of said chair when the platform is not being used by the user.

11 Claims, 2 Drawing Sheets

(56) References Cited

U.S. PATENT DOCUMENTS

| | | | | | |
|---|---|---|---|---|---|
| 5,174,631 | A * | 12/1992 | Schaevitz | A47C 7/004 | 297/423.19 X |
| 5,255,957 | A * | 10/1993 | Opsvik | A47C 9/005 | 297/423.37 X |
| 5,489,140 | A * | 2/1996 | Van Horn-Plato | A47C 1/04 | 297/423.21 X |
| 6,142,571 | A * | 11/2000 | Benden | A47C 7/004 | 297/423.4 |
| 6,607,246 | B1 * | 8/2003 | Benden | A47C 7/004 | 297/423.4 |
| 6,634,716 | B2 * | 10/2003 | Sander | A47C 7/506 | 297/423.21 X |
| 7,032,976 | B2 * | 4/2006 | Lin | A47C 7/506 | 297/423.21 |
| 7,036,886 | B2 * | 5/2006 | Benden | A47C 7/004 | 297/423.37 X |
| 7,374,247 | B2 * | 5/2008 | Welsh | A47C 7/52 | 297/423.19 |
| 7,452,034 | B2 * | 11/2008 | Jung | A47C 7/004 | 297/423.37 X |
| 9,149,678 | B2 * | 10/2015 | Shauli | A63B 21/4034 | |
| 9,642,465 | B1 * | 5/2017 | Park | A47C 7/52 | |
| 2019/0269248 | A1 * | 9/2019 | Beloff | A47C 7/52 | |

FOREIGN PATENT DOCUMENTS

| | | | |
|---|---|---|---|
| KR | 101651479 | B1 | 8/2016 |
| KR | 101673092 | B1 | 11/2016 |

* cited by examiner

FOOTREST FOR CHAIR AND ARMCHAIR

CROSS-REFERENCE TO RELATED APPLICATION

This application claims priority to Spanish Utility Model Application No. U201831325 filed Aug. 31, 2018, the disclosure of which is hereby incorporated by reference in its entirety.

BACKGROUND OF THE INVENTION

Field of the Invention

The present invention relates to a footrest for a chair and an armchair which has a configuration provided with one or more wheels.

The invention applies to all types of chairs and armchairs, and more specifically office chairs and armchairs which are equipped with wheels for movement.

Description of Related Art

In the state of the art, the use of footrests is known which enable the position of the legs and feet of a user when sitting to be modified, in order to improve the ergonomics thereof and to maintain a correct position of the legs, forming a 90° angle, preventing the appearance of back problems over time.

Footrests are useful for anyone who stays seated during long periods of time, but are especially necessary for those whose stature prevents their feet from resting on the ground, or they rest poorly, and they cannot keep their legs in the position recommended for preventing the appearance of back problems, that is forming a 90° angle.

In this manner, the Spanish utility model with application number U0277001 can be cited, wherein a footrest is described which is made up of a wedge-shaped body, equipped with two casings coupled together in an articulated manner, in order to enable the upper casing to form a platform which can adopt different selectable inclinations, facilitating the resting of the feet of the user with different inclinations and positions of their legs and feet.

This footrest has the drawback that it is an object independent from the chair, such that when the user wishes to remove it in order to adopt a more extended leg position, it must be pushed, which is difficult, since the footrest cannot be moved easily, for which reason the user must bend down in order to pick it up and place it somewhere else. Furthermore, by being detached from the chair it must be moved independently from the chair which is an added problem.

SUMMARY OF THE INVENTION

The present invention relates to a footrest for a chair and an armchair which has a configuration provided with one or more wheels which facilitates the movement thereof on the ground, and which is configured to be rotatably fastened onto the leg of a chair and an armchair with the object of enabling the footrest to move in the horizontal plane, preferably in a 360° angle, such that it can be located in any position of the horizontal plane in relation to the leg, for example in a position underneath the chair and armchair, or in a position outside the lower portion of the chair and armchair, or any other intermediate position in order to enable different support positions of the feet to be established, depending on the needs of the user at any time, facilitating the modification of the position of the feet and legs of the user in a very easy manner and enabling a correct positioning of the feet and legs, such that it prevents the long-term appearance of back problems due to a prolonged bad position of the legs and feet.

The invention solves the foregoing drawbacks by means of a footrest which is equipped with one or more wheels for movement and which is also joined to the leg of the chair or armchair with the possibility of rotating on the horizontal plane, enabling the footrest to always be joined to the chair and be placed in any position of the horizontal plane, all in a very easy manner, simply by slightly pushing the footrest with the feet of the user, which enables the footrest to adopt a multitude of positions with the simple movement of the footrest by means of the feet of the user. Furthermore, since the footrest is attached to the chair, especially in the case wherein it is applied to chairs with wheels, the movement of the chair and the footrest is performed with very little effort in a very easy manner when the chair is pushed.

In order to achieve the objectives and solve the aforementioned problems, the footrest of the invention comprises a support platform for the feet, and is characterized in that said platform is configured to be rotatably fastened onto one of the legs of the chair and armchair (hereinafter only the chair is cited in order to refer to both). That is, said platform is connected to the leg of a chair, such that if said chair moves in any plane of space, the platform moves together with the chair; however, the platform additionally has a degree of freedom with respect to the chair since it is able to rotate with respect to a shaft located at the fastening location between said platform and the chair even though said chair stays motionless.

Furthermore, the footrest comprises at least one wheel, such that the platform is enabled to move in the horizontal plane, preferably at a 360° angle. This configuration has the advantage that the platform is rotatably joined to one of the legs of the chair and has ease of movement due to the arrangement of the wheel, which enables the position of the platform to be modified with respect to the chair in any location in the horizontal plane, by simply actuating the platform by moving it with the feet of the user. In this manner, it is possible to modify the position of the feet and legs, and place them in the correct position in order to prevent long-term back problems from appearing due to having maintained a bad position of the legs and feet.

In order to enable the platform to be rotatably fastened onto one of the legs of the chair, it is envisaged that said platform comprise a housing through which it is fastened to the leg of the chair.

In one embodiment of the invention, the fastening of the leg of the chair through the housing of the platform is performed by means of a bushing which enables the rotation of the platform in the horizontal plane.

The invention can be applied to any type of chair, but is especially applied to chairs and armchairs comprising wheels, such that when the platform is fastened onto one of the legs of the chair, the wheel of the leg whereon the platform is fastened also constitutes a wheel for supporting and moving the platform, which facilitates the rotation of the platform and further enables the movement of the chair to be performed along with the platform, by simply pushing the chair, with minimal effort and in an easy manner.

More specifically, the footrest is applied to chairs and armchairs with wheels that have a configuration which enables the rotation thereof to be performed both on a horizontal shaft, as well as on a vertical shaft. Likewise, the at least one wheel of the platform is configured to rotate according to a horizontal shaft and according to a vertical shaft, such that this configuration facilitates both the rotation of the platform on the horizontal plane, and the movement of the chair assembly together with the platform. In this case, the vertical shaft whereon the wheel rotates, which is common to the platform and the chair, runs through the housing envisaged in the platform. More especially, it is applied in chairs wherein the legs are radial and rotatable in the horizontal plane, which is what enables more positions of use of the platform to be obtained, by enabling the leg to which the platform is joined to be located in any radial position underneath the chair and also enabling the 360° rotation of the platform in the horizontal plane.

In one embodiment of the invention, the platform comprises a triangular configuration wherein one of the sides thereof has a concave-curve configuration, which extends the support surface for the feet and enables the platform to rotate 360° in the horizontal plane, without running into any of the legs of the chair.

In the preferred embodiment, the platform comprises three wheels for support and movement arranged in the area of the vertexes of the triangular configuration.

BRIEF DESCRIPTION OF THE DRAWINGS

To complete the description, and for the purpose of helping to make the features of the invention more readily understandable, this description is accompanied by a set of figures constituting an integral part of the same, which by way of illustration and not limitation represents the following.

DESCRIPTION OF THE INVENTION

Figure 1:
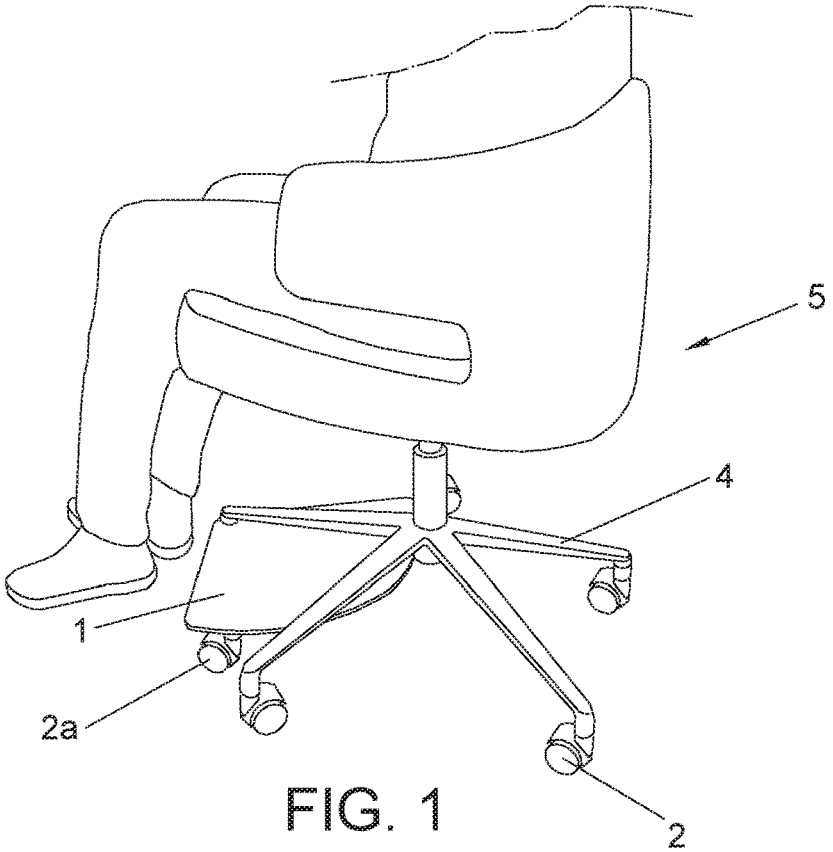
FIG. 1 shows a perspective view of the footrest applied to a typical wheeled office chair, in a position wherein it is located underneath the chair, without interfering with the feet of the user. In this position, it is also possible to position the feet under the chair by bending the legs backwards.
Figure 2:
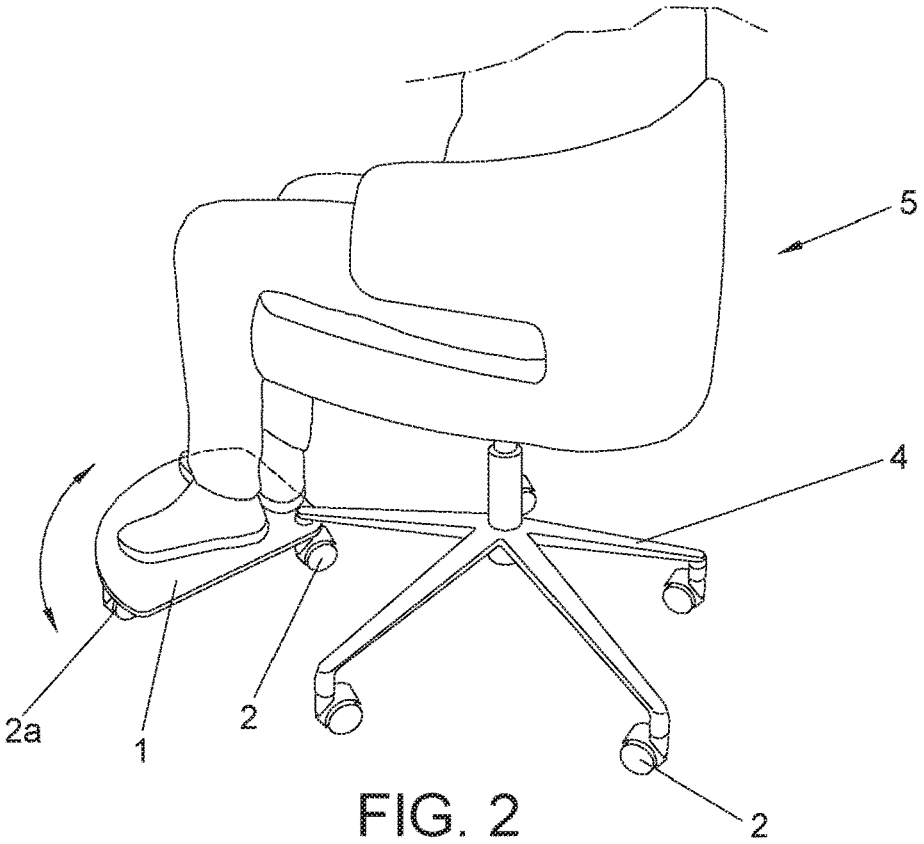
FIG. 2 shows a perspective view of the previous figure wherein the footrest occupies a position outside of the space underneath the chair, enabling the support for the feet of the user in a position in front of the chair.
Figure 3:
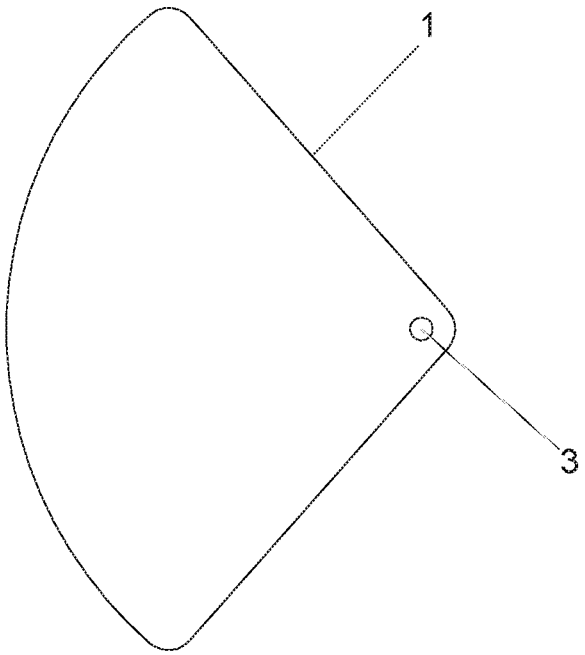
FIG. 3 shows a plan view of the footrest of the invention without the chair, in order to clarify the configuration thereof.
Figure 4:
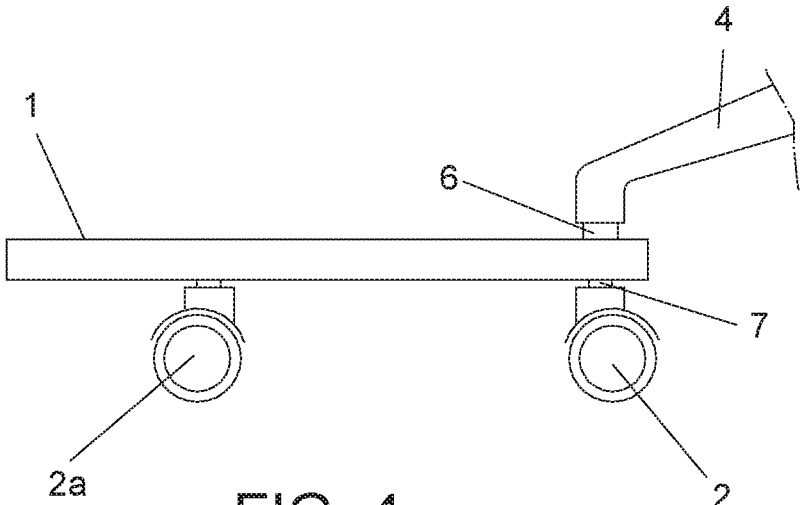
FIG. 4 shows a side view of the coupling of the footrest onto the leg of a chair. In this figure, the footrest is arranged in the position of FIG. 2.

The invention is described below based on the previously mentioned figures.

The footrest of the invention comprises a platform 1 which is equipped with a housing 3, which has been configured to be rotatably fastened onto a leg 4 of a chair 5, such that said leg 4 constitutes a support point for the platform 1. Furthermore, the platform 1 is provided with at least one wheel 2*a*, which constitutes another support point for the platform 1 on the ground, such that by means of the wheel 2*a*, it is possible to perform the angular movement of the platform 1 in the horizontal plane resting on the ground, said angular movement being guided through the fastening to the leg 4 of the chair 5.

This configuration enables the user, by means of their feet, to move the platform 1 in any position of the horizontal plane, such as in a position underneath the chair 5, or in a position outside of the space underneath the chair 5, or in any other intermediate position, such that the user can choose the wanted position in order to rest one or both feet thereon, and in a position both in front of the chair, as well as below it, which enables the position of the feet and legs of the user to be modified in multiple positions, and in a very easy manner, simply by actuating the platform 1 by moving it by means of the feet of the user. In this manner, it is possible to continuously modify the position of the feet and legs, and place them in the correct position in order to prevent long-term back problems from appearing due to a continuous bad position of the legs and feet.

The fastening of the leg 4 of the chair 5 in the housing 3 of the platform 1 is performed, for example, by means of a bushing 6, through which the rotation of the platform 1 in the horizontal plane is produced.

In the preferred embodiment, the platform 1 is applied in chairs 5 with wheels 2, such that the wheel 2 of the leg 4 whereon the platform 1 is fastened constitutes another point for support and movement of said platform 1, that in addition to the functionality described previously, also enables the movement of the platform 1 together with the chair, when the chair 5 is moved on the wheels 2 thereof, such that the chair and the footrest move together with minimal effort, simply by pushing the chair.

Finally, it should be noted that the wheels 2, 2*a*, are of the type that can rotate on both a vertical shaft 7 and a horizontal shaft, which facilitates both the movement of the chair and platform together; as well as the movement of the platform in the horizontal plane when it is being used, in order to modify the position of the feet and legs of the user, as commented previously.

Furthermore, according to the examples shown, the legs of the chair are radial and meet in a central vertical shaft which enables all of them to rotate 360° in the horizontal plane underneath the chair, which enables more positions of use of the platform 1 to be obtained, by enabling the leg to which the platform is joined to be located in any radial position underneath the chair and also enabling the 360° rotation of the platform in the horizontal plane.

In the example, the platform comprises a triangular configuration, with a convex-curve side, which increases the support surface on the platform and enables the platform to run freely without running into any of the legs of the chair, enabling the free movement of the platform in the horizontal plane, as described.

The invention claimed is:

1. A footrest for a chair, comprising:

a support platform for feet, wherein the platform is configured to be rotatably fastened to a leg of the chair in order to enable the movement of the platform in the horizontal plane and wherein the platform comprises at least one wheel, wherein the chair comprises a plurality of wheels, each of the plurality of wheels of the chair configured to rotate according to a respective vertical shaft, and wherein the vertical shaft of one of the plurality of wheels of the chair is common to the platform and the chair and runs through a housing of the platform.

2. The footrest according to claim 1, wherein an angle of rotation of the platform with respect to the fastening with the leg, in a horizontal plane, is 360°.

3. The footrest according to claim 1, wherein the housing is configured to rotatably fasten said platform to the leg of the chair.

4. The footrest according to claim 3, wherein the fastening of the leg of the chair through the housing of the platform comprises a bushing.

5. The footrest according to claim 1, wherein the at least one wheel fastened to the platform comprises at least one wheel for support and movement of the platform.

6. The footrest according to claim 5, wherein the legs of the chair have a radial arrangement and are configured to rotate together with respect to a normal line of a horizontal plane.

7. The footrest according to claim 5, wherein the plurality of wheels of the chair are further configured to rotate according to a horizontal shaft.

8. The footrest according to claim 1, wherein the at least one wheel of the platform is configured to rotate according to a horizontal shaft and according to a vertical shaft.

9. The footrest according to claim 1, wherein the platform comprises a triangular configuration.

10. The footrest according to claim 9, wherein one side of the triangular platform is a concave curve.

11. The footrest according to claim 9, wherein the platform comprises three wheels for support and movement arranged in an area of vertices of the triangular configuration.

* * * * *